US007528686B1

(12) United States Patent
Estes

(10) Patent No.: US 7,528,686 B1
(45) Date of Patent: May 5, 2009

(54) TUNABLE FILTER UTILIZING A CONDUCTIVE GRID

(75) Inventor: John C. Estes, Tempe, AZ (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 54 days.

(21) Appl. No.: 11/986,474

(22) Filed: Nov. 21, 2007

(51) Int. Cl.
*H01P 1/20* (2006.01)

(52) U.S. Cl. ..... 333/202; 333/204; 333/236

(58) Field of Classification Search ..... 333/202, 333/204, 238, 236; 343/909
See application file for complete search history.

(56) References Cited

U.S. PATENT DOCUMENTS

| | | | |
|---|---|---|---|
| 3,681,716 | A | 8/1972 | Chiron |
| 4,835,499 | A | 5/1989 | Pickett |
| 5,304,966 | A | 4/1994 | Hino |
| 5,543,764 | A | 8/1996 | Turunen |
| 6,054,908 | A | 4/2000 | Jackson |
| 6,166,613 | A | 12/2000 | Nakagawa |
| 6,216,020 | B1 | 4/2001 | Findikoglu |
| 6,452,465 | B1 | 9/2002 | Brown |
| 6,525,630 | B1 | 2/2003 | Zhu |
| 6,563,404 | B2 | 5/2003 | Fiedziuszko |
| 6,606,017 | B1 | 8/2003 | Xu |
| 6,686,817 | B2 | 2/2004 | Zhu |
| 6,717,491 | B2 | 4/2004 | Liang |
| 7,113,059 | B2 | 9/2006 | Asamura |
| 7,117,025 | B2 | 10/2006 | Shih |
| 7,148,770 | B2 | 12/2006 | Toncich |
| 7,236,068 | B2 | 6/2007 | Shamsaifar |

*Primary Examiner*—Stephen E Jones

(57) ABSTRACT

A tunable filter includes a first resonator; a second resonator; and, a conductive grid assembly electrically coupled to the first and second resonators and coupled to ground. The conductive grid assembly alters the coupling between the first and second resonators. The conductive grid assembly preferably includes a conductive grid element electrically coupled to the first and second resonators; and, a ground coupling element connected between the conductive grid element and ground for altering the coupling between the conductive grid element and ground.

18 Claims, 3 Drawing Sheets

TUNABLE FILTER UTILIZING A CONDUCTIVE GRID

BACKGROUND OF THE INVENTION

1. Field of the Invention

The present invention relates to tunable filters, and more particularly, to tunable filters that operate at radio frequencies.

2. Description of the Related Art

Wireless communications applications have increased to crowd the available spectrum and drive the need for high isolation between adjacent bands. Portability requirements of mobile communications additionally require a reduction in the size of communications equipment. Filters used in communications devices have been required to provide improved performance using smaller sized components. Efforts have been made to develop new types of resonators, new coupling structures, and new configurations to address these requirements.

Electrically tunable microwave filters have many applications in microwave systems. These applications include local multipoint distribution service (LMDS), personal communication systems (PCS), frequency hopping radio, satellite communications, and radar systems. There are three main kinds of microwave tunable filters, including mechanically, magnetically, and electrically tunable filters. Mechanically tunable filters suffer from slow tuning speed and large size. Compared to mechanically and magnetically tunable filters, electrically tunable filters have the important advantages of small size and fast tuning capability over relatively wide frequency bands. Electrically tunable filters include voltage-controlled tunable dielectric capacitor based tunable filters, and semiconductor varactor based tunable filters. Compared to semiconductor varactor based tunable filters, tunable dielectric capacitor based tunable filters have the merits of lower loss, higher power-handling, and higher IP3, especially at higher frequencies (>10 GHz).

Tunable filters offer communications service providers flexibility and scalability never before accessible. A single tunable filter can replace several fixed filters covering adjacent frequencies. This versatility provides transceiver front end RF tunability in real time applications and decreases deployment and maintenance costs through software controls and reduced component count. Also, fixed filters need to be wide band so that their count does not exceed reasonable numbers to cover the desired frequency plan. Tunable filters, however, are typically narrow band, but they can cover a larger frequency band than fixed filters by tuning the filters over a wide range. Additionally, narrowband filters at the front end are appreciated from the systems point of view, because they provide better selectivity and help reduce interference from nearby transmitters.

There are several patents that address either changing the resonant frequency of a resonator and/or changing the coupling between resonators in order to create a tunable filter. Two methods appear to predominate this prior art. One is to use a semiconductor varator diode by directly attaching it to the resonators (to ground for frequency shift and across resonators for coupling change). The second is to use a dielectric varactor (a ferro-electric material whose dielectric constant varies with an applied voltage.) This type of varactor is typically used as a layer between the conductors of a microstrip or strip line type of filter (combline, hairpin, interdigital), a substrate and a ground plane.

Dielectric varactors require large bias voltages and are likely to be somewhat lossy. Examples of these patents that utilize dielectric varactors include: U.S. Pat. No. 7,148,770, entitled "Electrically Tunable Bandpass Filters," issued to Toncich; U.S. Pat. No. 6,525,630, entitled "Microstrip Tunable Filters Tuned by Dielectric Varactors," issued to Zhu et al.; U.S. Pat. No. 6,686,817, entitled "Electronic Tunable Filters with Dielectric Varactors," issued to Zhu et al.; and, U.S. Pat. No. 6,216,020, entitled "Localized Electrical Fine Tuning of Passive Microwave and Radio Frequency Devices", issued to Findikoglu.

The disadvantage of the diode varactors for changing the coupling is that the coupling capacitances are so low that they are challenging to use and since they have to be connected directly to the resonators the biasing circuit affects the performance. Examples of these patents that utilize semiconductor diode varactors include: U.S. Pat. No. 7,113,059, entitled "Variable-Frequency High Frequency Filter," issued to Asamura; U.S. Pat. No. 6,717,491, entitled "Hairpin Microstrip Line Electrically Tunable Filters," issued to Liang et al.; and, U.S. Pat. No. 4,835,499, entitled "Voltage Tunable Bandpass Filter," issued to Pickett.

SUMMARY OF THE INVENTION

In its broadest aspects, the present invention is a tunable filter that includes a first resonator; a second resonator; and, a conductive grid assembly electrically coupled to the first and second resonators and coupled to ground. The conductive grid assembly alters the coupling between the first and second resonators.

The conductive grid assembly preferably includes a conductive grid element electrically coupled to the first and second resonators; and, a ground coupling element connected between the conductive grid element and ground for altering the coupling between the conductive grid element and ground.

As the conductive grid assembly is coupled to ground, the capacitance between the resonators is diminished, thereby reducing the coupling of the two resonators.

Unlike the patents discussed above, the varactors are not coupled between the resonators. Instead, they are connected to a conductive grid assembly.

Use of the tunable electronics disclosed in the present invention has the potential to minimize the number of required components. Currently, several radio programs require a bank of switched filter banks of varying bandwidths. With the present technique, variable bandwidth filters can be designed. Another possibility is as a filter that can be switched off thereby eliminating the need for a switch and improving performance.

DETAILED DESCRIPTION OF THE INVENTION

Figure 1A:
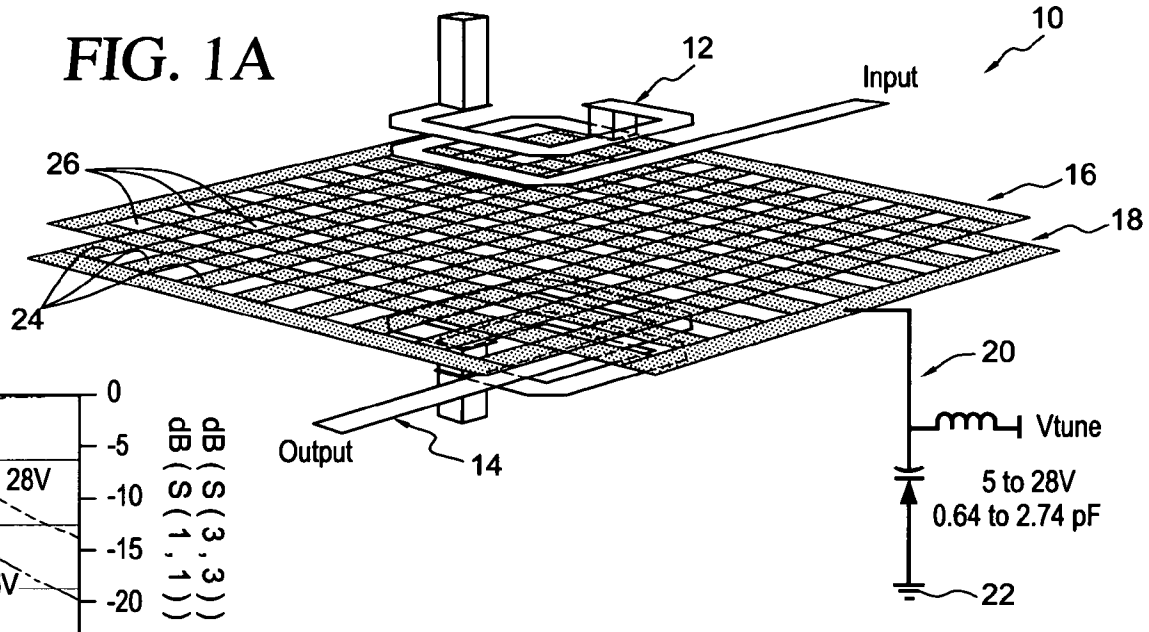
FIG. 1A is a schematic illustration of a first embodiment of the tunable filter of the present invention utilizing vertically coiled resonators and a single layer conductive grid assembly.

Referring now to the drawings and the characters of reference marked thereon, FIG. 1A illustrates a first embodiment of a tunable filter, designated generally as 10, in accordance with the principles of the present invention. The tunable filter 10 includes a first resonator 12 and a second resonator 14. A conductive grid assembly 16 is electrically coupled to the first and second resonators 12, 14 and coupled to ground. The conductive grid assembly 16 alters the coupling between the first and second resonators 12, 14.

Coil resonators 12, 14 are shown in FIG. 1A although other suitable types of resonators can be used such as microstrip resonators, stripline resonators, or resonant cavities. In this FIG. 1A embodiment the resonators are illustrated in a vertically coiled orientation. However, as will be seen below, they may be, alternatively, positioned horizontally.

The conductive grid assembly 16 preferably includes a conductive grid element 18 electrically coupled to the first and second resonators 12, 14; and, a ground coupling element 20 connected between the conductive grid element 18 and ground 22 for altering the coupling between the conductive grid element 18 and ground 22. The conductive grid element 18 comprises a conductive section 24 and a plurality of dielectric sections 26 adjacent to the conductive section 24 and arranged in a grid pattern. The conductive grid element 18 is formed of a conductive substance, generally a metal such as copper, silver, or gold screen printed on to a substrate; or may be a printed circuit board with etched out openings; or a multilayer trace with vias. Those skilled in the art are aware of a number of different ways that such a grid can be formed. The dielectric sections 26 may be air openings or may contain another dielectric material such as a ceramic material. FIG. 1A illustrates use of a single-layered conductive grid element 18; however, as will be disclosed below, multi-layered conductive grid elements may be utilized.

The ground coupling element 20 may include, for example, a varactor, switch capacitor bank, RF switch, or mechanical switch. As shown in FIG. 1A, it may have an inductor connected to a variable voltage supply to provide the varying coupling.

Figure 1B:
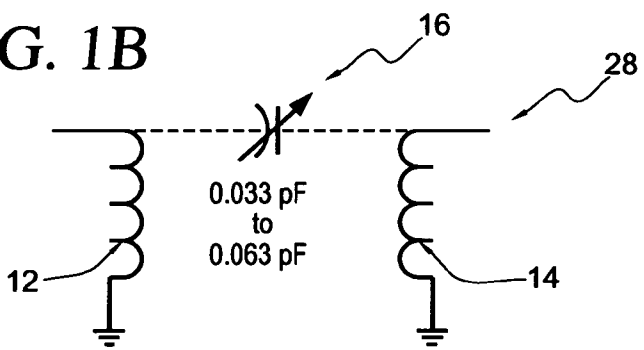
FIG. 1B is a simplified electrical schematic of the tunable filter of FIG. 1A.

Referring now to FIG. 1B a simplified electrical schematic of the tunable filter of FIG. 1A is illustrated, designated generally as 28. The resonators 12, 14 are coupled through the tunable conductive grid assembly 16, which operates as a "floating" grid. As the grid is coupled to ground, the capacitance between the resonators is diminished, thereby reducing the coupling of the two resonators.

Figure 1C:
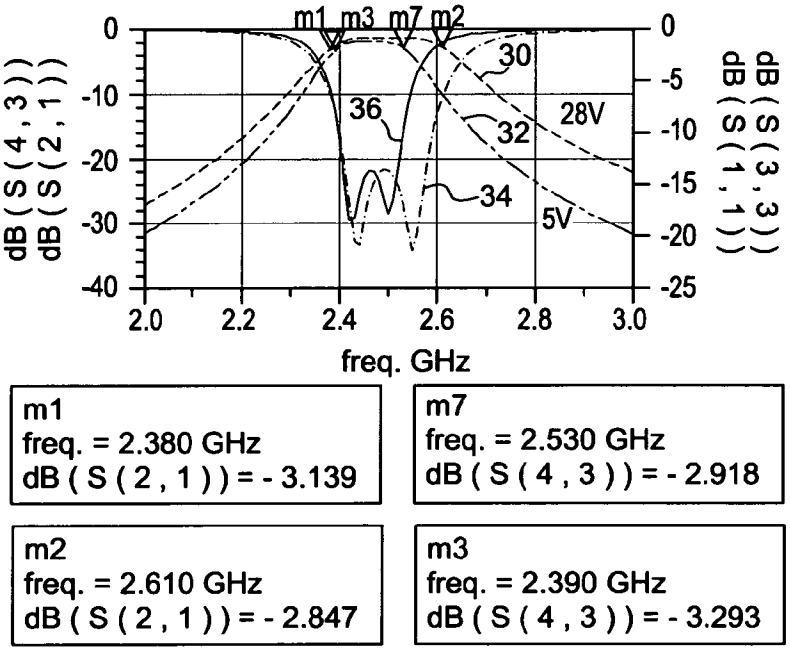
FIG. 1C is a graph of decibels vs. frequency for the voltage being changed from 5V to 28V showing the change in the coupling therebetween, relative to the FIG. 1A embodiment.

Referring now to FIG. 1C, the results of an investigation performed using an EM simulator is illustrated. This investigation used low temperature co-fired ceramics (LTCC) technology. Curve 30 shows the frequency response curve with 28V applied to the varactor resulting in a capacitance of 0.64 pF. Curve 32 shows the frequency response curve with 5V applied to the varactor resulting in a capacitance of 2.74 pF. In this example, the bandwidth has been reduced from 230 MHz to 140 MHz. The relatively wide bandwidth of curve 30 (28V) illustrates the low capacitance/greater coupling while tuning from 5V to 28V. The capacitance required to change the coupling of the resonators is magnified 20× to 40× resulting in capacitances that are more manageable to vary. In addition, the ratio of capacitance is greater reducing the sensitivity. Curves 34 and 36 illustrate the return loss of the filter.

Figure 2:
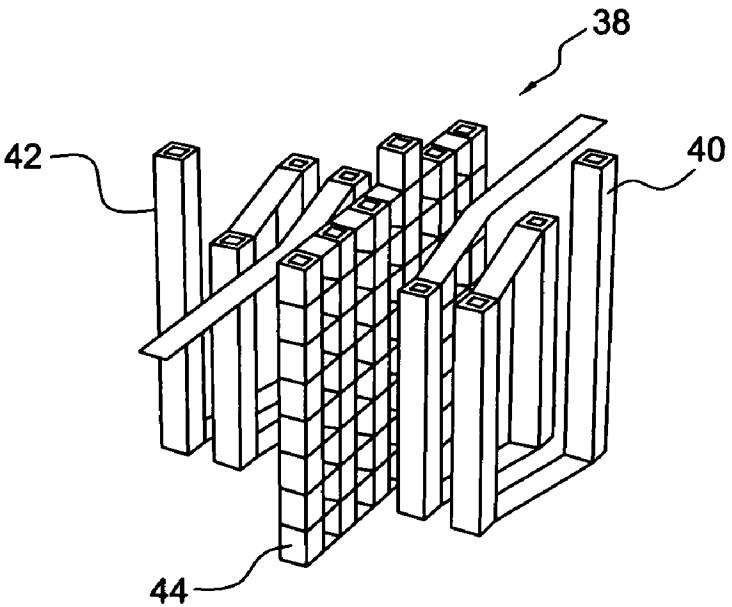
FIG. 2 is a schematic illustration of a second embodiment of the tunable filter of the present invention utilizing horizontally coiled resonators and a multi-layer conductive grid assembly.

Referring now to FIG. 2, a second embodiment of the tunable filter of the present invention is illustrated, designated generally as 38, utilizing horizontally coiled resonators 40, 42 and a multi-layer conductive grid assembly 44. The orientation of the resonators and layering of the conductive grid assembly would be in accordance with the user's design parameter requirements.

Figure 3:
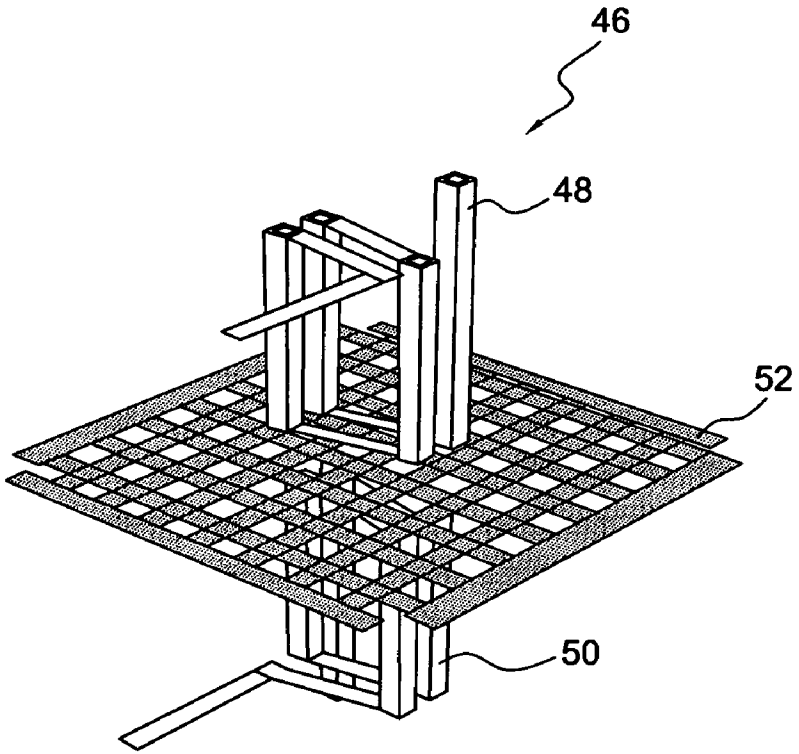
FIG. 3 is a schematic illustration of a third embodiment of the tunable filter of the present invention utilizing horizontally coiled resonators and a single layer conductive grid assembly.

In FIG. 3, a third embodiment of the tunable filter of the present invention is illustrated, designated generally as 46, utilizing horizontally coiled resonators 48, 50 and a single layer conductive grid assembly 52.

Figure 4A:
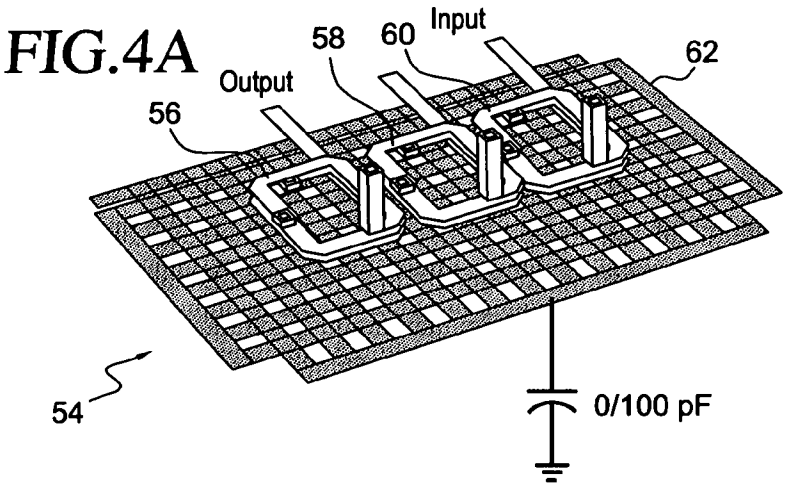
FIG. 4A is a schematic illustration of a fourth embodiment of the tunable filter of the present invention utilizing three resonators placed on one side of a single layer conductive grid assembly.
Figure 4B:
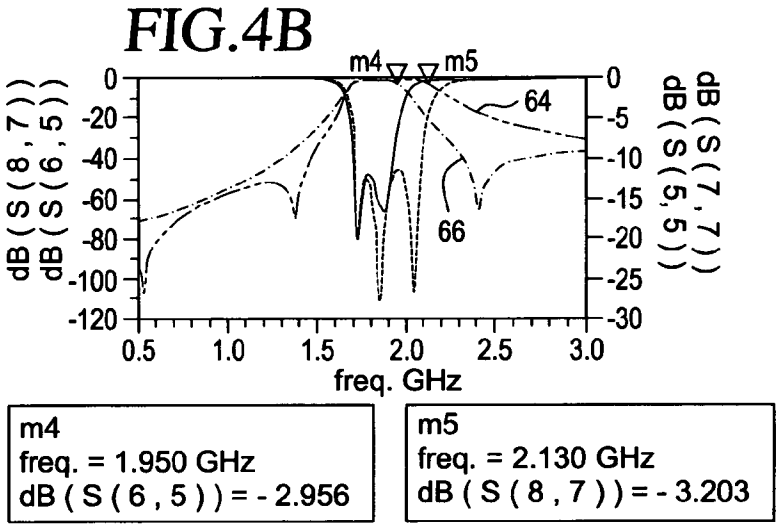
FIG. 4B is a graph of decibels vs. frequency, for the coupling between the conductive grid and ground being changed from 0 pF to 100 pF at a single point on the grid, showing the change in the coupling therebetween, relative to the FIG. 4B embodiment.

Referring now to FIG. 4A, a fourth embodiment of the tunable filter of the present invention utilizing three resonators is illustrated, designated generally as 54. In this embodiment, all three of the resonators 56, 58, 60 are placed on one side of a single layer conductive grid assembly 62. This provides some simplification in design over the embodiments of FIGS. 1-3 if over two resonators are used. In this embodiment, the conductive grid assembly is coupled to ground at a single point creating a pole of attenuation near the pass-band as shown FIG. 4B curve 66. This pole of attenuation is also tunable as can be seen from curve 64 as the coupling element is changed from 0 pF to 100 pF allowing for additional control of attenuating spurious frequencies.

Figure 5A:
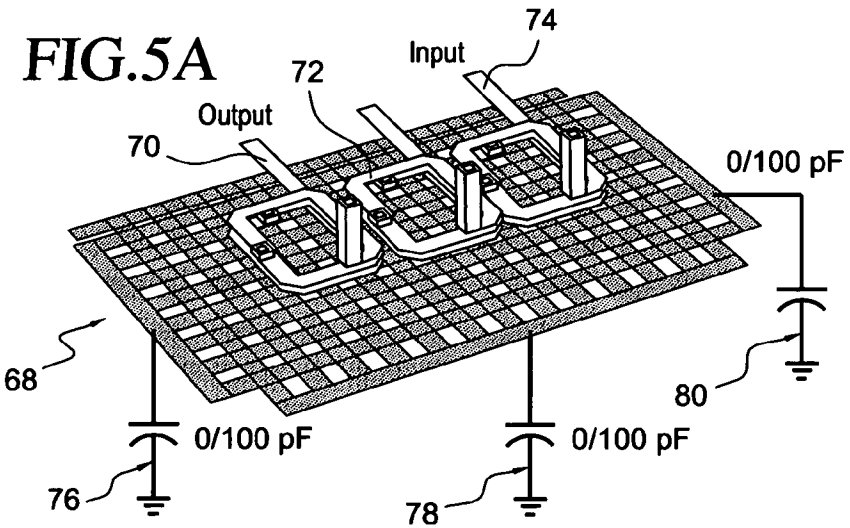
FIG. 5A is a schematic illustration of a fifth embodiment of the tunable filter of the present invention utilizing three resonators placed on one side of a single layer conductive grid assembly having three ground coupling elements.
Figure 5B:
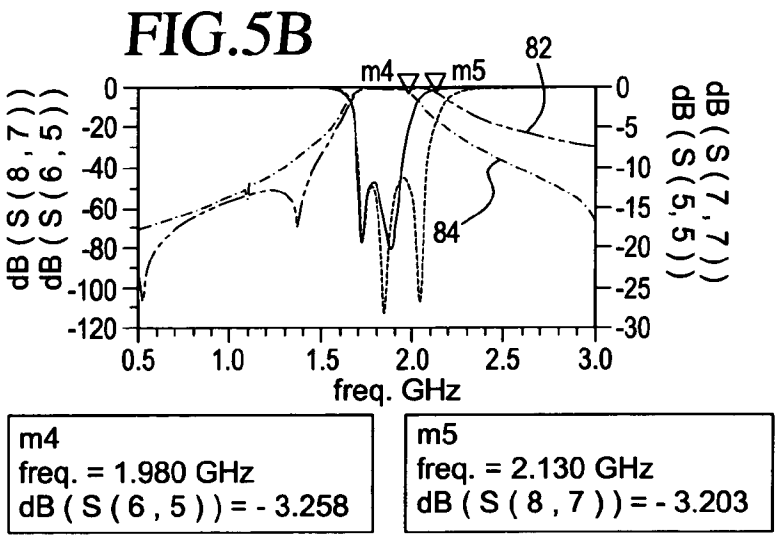
FIG. 5B is a graph of decibels vs. frequency, for the coupling between the conductive grid and ground being changed from 0 pF to 100 pF at three sides of the grid, showing the change in the coupling therebetween, relative to the FIG. 5B embodiment.

FIG. 5A shows an embodiment, designated generally as 68, again using three resonators 70, 72, 74. In this embodiment, the conductive grid assembly is coupled to ground at three points reducing the proximity of the pole of attenuation near the pass-band as shown in FIG. 5B curve 84. This pole of attenuation is also tunable as can be seen from curve 82 as the coupling elements 76, 78, 80 are changed from 0 pF to 100 pF allowing for additional control of attenuating spurious frequencies.

Although several embodiments have been illustrated, other embodiments and configurations may be devised without departing from the spirit of the invention and the scope of the appended claims.

Furthermore, although the principles of this invention have been discussed relative to a tunable filter they can be used for a tunable coupler, balun or other coupled line type of circuit that can benefit from tuning.

The invention claimed is:

1. A tunable filter, comprising:

a) a first resonator;

b) a second resonator; and, c) a conductive grid assembly electrically coupled to said first and second resonators and coupled to ground, said conductive grid assembly for altering the coupling between said first and second resonators.

2. The tunable filter of claim 1, wherein said first and second resonators are positioned in a vertically coiled orientation.

3. The tunable filter of claim 1, wherein said first and second resonators are positioned in a horizontally coiled orientation.

4. The tunable filter of claim 1, further comprising at least one additional resonator coupled to said conductive grid assembly.

5. The tunable filter of claim 1, wherein said conductive grid assembly, comprises:

a) a conductive grid element electrically coupled to said first and second resonators; and, b) a ground coupling element connected between said conductive grid element and ground for altering the coupling between said conductive grid element and ground.

6. The tunable filter of claim 5, wherein said ground coupling element comprises an inductor connected to a variable voltage supply.

7. The tunable filter of claim 5, wherein said ground coupling element comprises an RF switch.

8. The tunable filter of claim 5, wherein said conductive grid element is multi-layered.

9. The tunable filter of claim 5, wherein said conductive grid element is single-layered.

10. The tunable filter of claim 5, further comprising at least one additional ground coupling element connected between said conductive grid element and ground.

11. The tunable filter of claim 5, wherein said ground coupling element comprises a mechanical switch.

12. The tunable filter of claim 5, wherein said ground coupling element comprises a switch capacitor bank.

13. The tunable filter of claim 5, wherein said ground coupling element comprises a varactor.

14. The tunable filter of claim 5, wherein said conductive grid element comprises a conductive section and a plurality of dielectric sections adjacent to said conductive section and arranged in a grid pattern.

15. The tunable filter of claim 14, wherein said dielectric sections comprise air openings.

16. The tunable filter of claim 14, wherein said dielectric sections comprise dielectric ceramic materials.

17. A tunable filter, comprising:

a) a first resonator;

b) a second resonator; and, c) a conductive grid assembly electrically coupled to said first and second resonators and coupled to ground, said conductive grid assembly, comprising:

i. a conductive grid element electrically coupled to said first and second resonators, said conductive grid assembly, comprising:

1. conductive section, and;

2. a plurality of dielectric sections adjacent to said conductive section and arranged in a grid pattern; and, ii. a ground coupling element connected between said conductive grid element and ground for altering the coupling between said conductive grid element and ground, said ground coupling element comprising an inductor connected to a variable voltage supply, wherein said conductive grid assembly alters the coupling between said first and second resonators.

18. A method for actively tuning a filter, comprising the steps of:

a) providing a first resonator;

b) providing a second resonator;

c) electrically coupling said first and second resonators utilizing a conductive grid assembly coupled to ground; and, d) utilizing said conductive grid assembly for altering the coupling between said first and second resonators.

* * * * *